US011094253B2

(12) United States Patent
Yuan et al.

(10) Patent No.: US 11,094,253 B2
(45) Date of Patent: Aug. 17, 2021

(54) PIXEL DRIVING CIRCUIT, METHOD FOR DRIVING THE SAME, ARRAY SUBSTRATE AND DISPLAY DEVICE

(71) Applicants: HEFEI BOE JOINT TECHNOLOGY CO., LTD., Anhui (CN); BOE TECHNOLOGY GROUP CO., LTD., Beijing (CN)

(72) Inventors: Zhidong Yuan, Beijing (CN); Taejin Kim, Beijing (CN); Yongqian Li, Beijing (CN); Lin Sun, Beijing (CN); Chao Jiao, Beijing (CN); Can Yuan, Beijing (CN); Zehua Ding, Beijing (CN); Xuehuan Feng, Beijing (CN); Meng Li, Beijing (CN)

(73) Assignees: HEFEI BOE JOINT TECHNOLOGY CO., LTD., Anhui (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/840,176

(22) Filed: Apr. 3, 2020

(65) Prior Publication Data

US 2021/0074210 A1 Mar. 11, 2021

(30) Foreign Application Priority Data

Sep. 10, 2019 (CN) ..... 201910854467.5

(51) Int. Cl.
*G09G 3/3233* (2016.01)

(52) U.S. Cl.
CPC ..... *G09G 3/3233* (2013.01); *G09G 2300/043* (2013.01); *G09G 2300/0819* (2013.01); *G09G 2310/0251* (2013.01)

(58) Field of Classification Search
None
See application file for complete search history.

(56) References Cited

U.S. PATENT DOCUMENTS

2004/0160394 A1* 8/2004 Irmer ..... G09G 3/3275 345/82
2006/0170628 A1* 8/2006 Yamashita ..... G09G 3/3266 345/76

(Continued)

FOREIGN PATENT DOCUMENTS

CN 101114422 A 1/2008
CN 101211535 A 7/2008

(Continued)

OTHER PUBLICATIONS

First Office Action for Chinese Application No. 201910854467.5, dated Aug. 5, 2020, 9 Pages.

*Primary Examiner* — Dorothy Harris
(74) *Attorney, Agent, or Firm* — Brooks Kushman P.C.

(57) ABSTRACT

A pixel driving circuit, array substrate, display device and method for driving the pixel driving circuit are provided, the circuit includes: a control terminal and a first terminal of a driving switch circuit are respectively coupled to a first terminal of a data input switch circuit and an anode of a light-emitting device, and two terminals of a storage capacitor are respectively coupled to the control terminal of the driving switch circuit and the anode of the light-emitting device, two terminals of an intrinsic capacitor are respectively coupled to a cathode and the anode of the light-emitting device, a first terminal and a second terminal of a reset switch circuit are respectively coupled to the anode and the cathode of the light-emitting device, a capacitance of the intrinsic capacitor is greater than or equal to a preset multiple of a capacitance of the storage capacitor.

20 Claims, 4 Drawing Sheets

(56) References Cited

U.S. PATENT DOCUMENTS

| | | | | |
|---|---|---|---|---|
| 2008/0049007 | A1 | 2/2008 | Iida et al. | |
| 2008/0158110 | A1 | 7/2008 | Iida et al. | |
| 2008/0225027 | A1 | 9/2008 | Toyomura et al. | |
| 2009/0244055 | A1 | 10/2009 | Asano et al. | |
| 2010/0053144 | A1* | 3/2010 | Akimoto | G09G 3/3233 345/213 |
| 2014/0111557 | A1* | 4/2014 | Omata | G09G 3/3233 345/690 |
| 2017/0140707 | A1 | 5/2017 | Xu et al. | |
| 2018/0144683 | A1 | 5/2018 | Shin | |
| 2018/0308426 | A1 | 11/2018 | Han et al. | |
| 2020/0342812 | A1* | 10/2020 | Xu | G09G 3/3233 |

FOREIGN PATENT DOCUMENTS

| | | | | |
|---|---|---|---|---|
| CN | 101266755 | A | 9/2008 | |
| CN | 101546519 | A | 9/2009 | |
| CN | 101986378 | A | 3/2011 | |
| CN | 104575379 | A | 4/2015 | |
| CN | 104715723 | A | 6/2015 | |
| CN | 104715726 | A | 6/2015 | |
| CN | 104867441 | A | 8/2015 | |
| CN | 106782325 | A | 5/2017 | |
| CN | 106952615 | A | 7/2017 | |
| CN | 110100275 | A | 8/2019 | |
| WO | WO-2018210329 | A1 * | 11/2018 | G09G 3/3233 |

* cited by examiner

PIXEL DRIVING CIRCUIT, METHOD FOR DRIVING THE SAME, ARRAY SUBSTRATE AND DISPLAY DEVICE

CROSS-REFERENCE TO RELATED APPLICATION

This application claims priority to Chinese Patent Application No. 201910854467.5 filed on Sep. 10, 2019, which is incorporated herein by reference in its entirety.

TECHNICAL FIELD

The present disclosure relates to the field of display technologies, in particular to a pixel driving circuit, an array substrate, a display device and a method for driving the pixel driving circuit.

BACKGROUND

An AMOLED (Active-Matrix Organic Light Emitting Diode) panel has advantages such as high contrast, wide viewing angle, and fast response. The AMOLED panels are expected to take the place of liquid crystal panels and become mainstream choices of next-generation displays.

Since electroluminescent (EL) devices are required in an organic light emitting diode (OLED) product to emit light, and light-emitting currents required for the EL devices are provided by driving transistors, it is necessary to improve the characteristic uniformity of the driving transistors to ensure the light-emitting uniformity of the OLED product. Therefore, it is particularly important to compensate for a current variance caused by drifts of a threshold voltage and a mobility of the driving transistors.

SUMMARY

A pixel driving circuit is provided in embodiments of the present disclosure. The pixel driving circuit is applied to an array substrate and includes: a data input switch circuit, a driving switch circuit, a reset switch circuit, a light-emitting device, a storage capacitor and an intrinsic capacitor, where a control terminal of the driving switch circuit is coupled to a first terminal of the data input switch circuit, a first terminal of the driving switch circuit is coupled to an anode of the light-emitting device, and two terminals of the storage capacitor are respectively coupled to the control terminal of the driving switch circuit and the anode of the light-emitting device, two terminals of the intrinsic capacitor are respectively coupled to a cathode of the light-emitting device and the anode of the light-emitting device, a first terminal of the reset switch circuit is coupled to the anode of the light-emitting device, a second terminal of the reset switch circuit is coupled to the cathode of the light-emitting device, a capacitance value of the intrinsic capacitor is greater than or equal to a preset multiple of a capacitance value of the storage capacitor, and a duration of a threshold voltage detection stage of the pixel driving circuit is greater than or equal to a preset duration.

Optionally, the array substrate includes an auxiliary cathode, and a second terminal of the reset switch circuit is coupled to the cathode of the light-emitting device via the auxiliary cathode.

Optionally, the reset switch circuit is a third transistor, and the auxiliary cathode is disposed in a same layer as first and second electrodes of the third transistor.

Optionally, the array substrate further includes a base substrate, an orthographic projection of the second electrode of the third transistor onto the base substrate and an orthographic projection of the auxiliary cathode onto the base substrate at least partially overlap.

Optionally, the capacitance value of the intrinsic capacitor is greater than or equal to 8 times of the capacitance value of the storage capacitor.

Optionally, the duration of the threshold voltage detection stage of the pixel driving circuit is greater than or equal to 15 us.

Optionally, the data input switch circuit includes a first transistor, the driving switch circuit includes a second transistor, a control electrode of the first transistor receives a first scanning signal, and a first electrode of the first transistor is coupled to a control electrode of the second transistor, and a second electrode of the first transistor is coupled to a data signal line; the first transistor is configured to transmit a reset voltage and a data signal on the data signal line to the control electrode of the second transistor in response to the first scanning signal; a first electrode of the second transistor is coupled to the anode of the light-emitting device, and a second electrode of the second transistor is coupled to a first voltage terminal.

Optionally, the reset switch circuit includes a third transistor, a control electrode of the third transistor receives a second scanning signal, and a first electrode of the third transistor is coupled to the anode of the light-emitting device, and a second electrode of the third transistor is coupled to the cathode of the light-emitting device; the third transistor is configured to apply the reset voltage transmitted by the first transistor to the control electrode of the second transistor in response to the second scanning signal.

Optionally, the first transistor, the second transistor and the third transistor are N-channel thin film transistors (NTFTs).

Optionally, the array substrate includes a source/drain layer, a light-shield layer and a gate layer, the gate layer is coupled to the light-shield layer through a first via hole, and the gate layer is coupled to the source/drain layer through a second via hole.

An array substrate is further provided in embodiments of the present disclosure. The array substrate includes: a plurality of pixel units arranged in an array, where each of the plurality of pixel units includes the pixel driving circuit described above.

A display device is further provided in embodiments of the present disclosure. The display device includes the array substrate described above.

A method for driving the pixel driving circuit is further provided in embodiments of the present disclosure. The method includes a reset stage, a threshold voltage detection stage, a data writing and compensation stage and a light-emitting stage, where:

during the reset stage, turning on the reset switch circuit and the data input switch circuit, and turning on the driving switch circuit via the reset switch circuit and the data input switch circuit to reset the driving switch circuit;

during the threshold voltage detection stage, turning off the reset switch circuit, and turning off the driving switch circuit after detecting a threshold voltage of the driving switch circuit via the data input switch circuit and the intrinsic capacitor; where the duration of the threshold voltage detection stage is greater than or equal to the preset duration;

during the data writing and compensation stage, inputting the data signal via the data input switch circuit, turning on the driving switch circuit, and compensating, by the intrinsic capacitor, for the threshold voltage and a mobility of the driving switch circuit;

during the light-emitting stage, turning off the data input switch circuit, and driving, by the driving switch circuit, the light-emitting device to emit light.

DETAILED DESCRIPTION

In order to make objectives, features and advantages of the present disclosure more comprehensible, the present disclosure is described in further detail below with reference to the accompanying drawings and specific embodiments.

Figure 1:
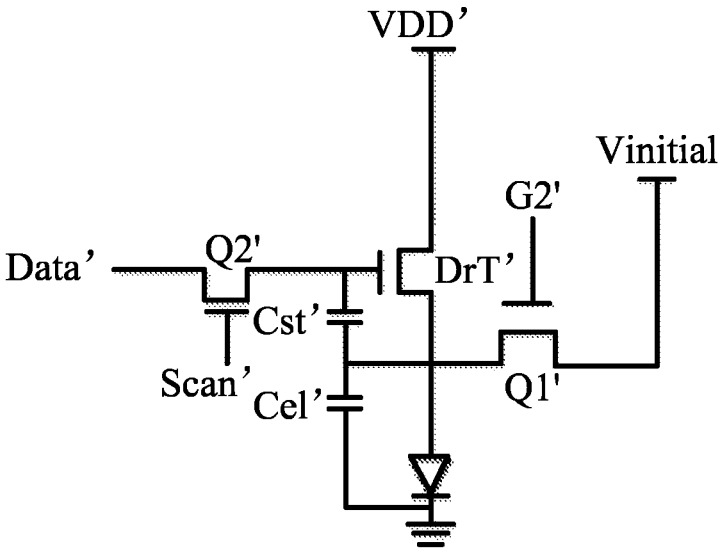
Fig. 1 (PRIOR ART)
FIG. 1 is a schematic structural diagram of a pixel driving circuit in the related art.

In the related art, a pixel driving circuit as shown in FIG. 1 is used to compensate for a current variance caused by drifts of a threshold voltage and a mobility of the driving transistor. However, the pixel driving circuit has the following disadvantages: the pixel driving circuit requires a sensing signal line to introduce a reset signal Vinitial to a source electrode of a transistor Q1', such that a structure of the pixel driving circuit is complicated, and an area of an OLED product adopting the pixel driving circuit is large, which is not conducive to a realization of a narrow-bezel OLED product.

In view of the above problems, a pixel driving circuit, an array substrate, a display device, and a method for driving the pixel driving circuit are provided in the embodiments of the present disclosure to solve the problem of the complicated structure of the pixel driving circuit in the related art.

Figure 2:
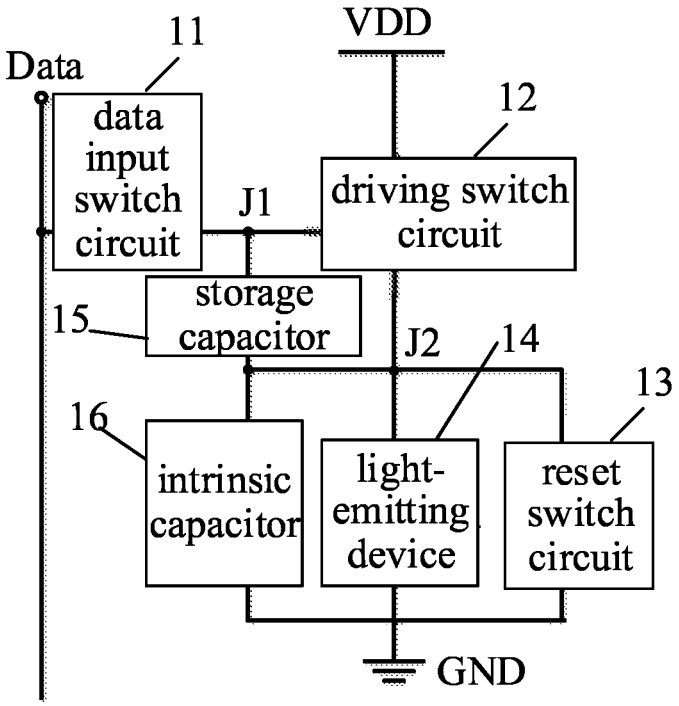
FIG. 2 is a schematic structural diagram of an embodiment of a pixel driving circuit according to the present disclosure.

Referring to FIG. 2, FIG. 2 is a schematic structural diagram of an embodiment of the pixel driving circuit according to the present disclosure. The pixel driving circuit is applied to an array substrate, as shown in FIG. 2, the pixel driving circuit includes: a data input switch circuit 11, a driving switch circuit 12, a reset switch circuit 13, a light-emitting device 14, a storage capacitor 15 and an intrinsic capacitor 16, a control terminal of the driving switch circuit 12 is coupled to a first terminal of the data input switch circuit 11, a first terminal of the driving switch circuit 12 is coupled to an anode of the light-emitting device 14, and two terminals of the storage capacitor 15 are respectively coupled to the control terminal of the driving switch circuit 12 and the anode of the light-emitting device 14, two terminals of the intrinsic capacitor 16 are respectively coupled to a cathode of the light-emitting device 14 and the anode of the light-emitting device 14, a first terminal of the reset switch circuit 13 is coupled to the anode of the light-emitting device 14, a second terminal of the reset switch circuit 13 is coupled to the cathode of the light-emitting device 14, a capacitance value of the intrinsic capacitor 16 is greater than or equal to a preset multiple of a capacitance value of the storage capacitor 15, and a duration of a threshold voltage detection stage of the pixel driving circuit is greater than or equal to a preset duration.

Figure 3:
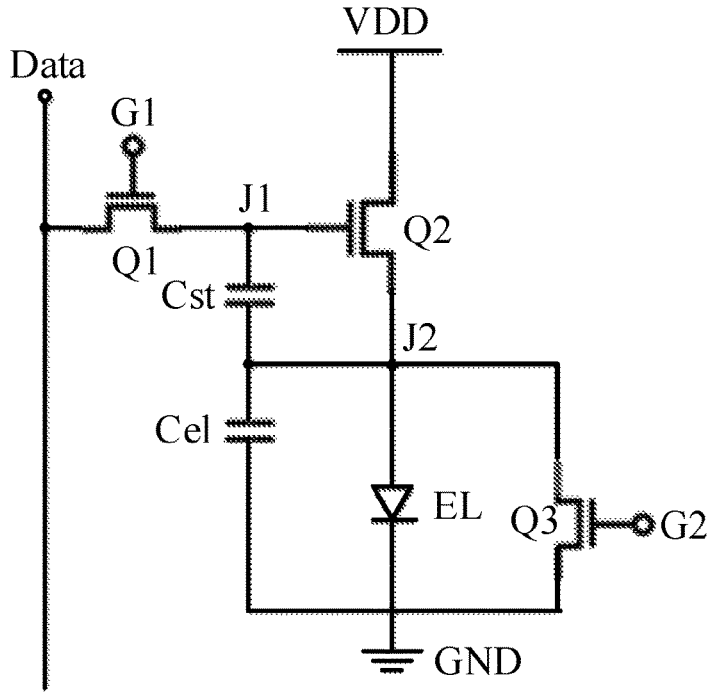
FIG. 3 is a schematic structural diagram of an embodiment of a pixel driving circuit according to the present disclosure.

In some embodiments, as shown in FIG. 3, the data input switch circuit 11 is a first transistor Q1, the driving switch circuit 12 is a second transistor Q2, the reset switch circuit 13 is a third transistor Q3, the light-emitting device 14 is a light-emitting device EL, the storage capacitor 15 is a storage capacitor Cst and the intrinsic capacitor 16 is an intrinsic capacitor Cel. A control electrode of the first transistor Q1 receives a first scanning signal G1, a second electrode of the first transistor Q1 is coupled to a data signal line Data, and the first transistor Q1 is configured to transmit a reset voltage Vref and a data signal Vdata on the data signal line Data to a first node J1 in response to the first scanning signal G1, so as to control a potential at the first node J1. The first node J1 is located between a control electrode of the second transistor Q2 and a first electrode of the first transistor Q1, the control electrode of the second transistor Q2 is coupled to the first node J1, a second electrode of the second transistor Q2 is coupled to a first voltage terminal, e.g., a power supply VDD, and the second transistor Q2 is configured to generate a driving current Ids for driving the light-emitting device EL to emit light. There is a second node J2 between an anode of the light-emitting device EL and a first electrode of the second transistor Q2, the anode of the light-emitting device EL is coupled to the second node J2, a cathode of the light-emitting device EL is grounded, and the light-emitting device EL is configured to emit light in response to the driving current Ids. A control electrode of the third transistor Q3 receives a second scanning signal G2, a first electrode of the third transistor Q3 is coupled to the second node J2, and the third transistor Q3 is configured to apply the reset voltage Vref transmitted by the first transistor Q1 to the control electrode of the second transistor Q2 in response to the second scanning signal G2. One terminal of the storage capacitor Cst is coupled to the first node J1, and the other terminal of the storage capacitor Cst is coupled to the second node J2. The storage capacitor Cst is configured to store electric charges when the second transistor Q2 is turned on. One terminal of the intrinsic capacitor Cel is coupled to the second node J2, the other terminal of the intrinsic capacitor Cel is coupled to the cathode of the light-emitting device EL. The intrinsic capacitor Cel is configured to store electric charges when the second transistor Q2 is turned on (for example, the second transistor Q2 is turned on during a reset stage T1 and a threshold voltage detection stage T2), so that a potential at the first electrode of the second transistor Q2 is maintained at a difference between the reset voltage Vref and a threshold voltage Vth of the second transistor Q2.

By setting a capacitance value of the intrinsic capacitor Cel to be greater than or equal to a preset multiple of a capacitance value of the storage capacitor Cst, and setting a duration of the threshold voltage detection stage T2 of the pixel driving circuit to be greater than or equal to the preset duration, the amount of electric charges stored in the intrinsic capacitor Cel is much greater than the amount of electric charges stored in the storage capacitor Cst after the threshold voltage detection stage T2, such that the potential at the first electrode of the second transistor Q2 that is coupled to the anode of the light-emitting device EL is maintained at the difference between the reset voltage Vref of the pixel driving circuit and the threshold voltage Vth of the second transistor Q2, thereby ensuring a compensation for drifts of the threshold voltage Vth and a mobility k of the second transistor Q2.

Additionally, since the second electrode of the third transistor Q3 is coupled to the cathode of the light-emitting device EL, the third transistor Q3 may reset the second transistor Q2 without a reset signal Vinitial, such that there is no need to introduce the reset signal Vinitial to the second electrode of the third transistor Q3 in the pixel driving circuit, that is, there is no need to provide a sensing signal line in the pixel driving circuit to provide the reset signal Vinitial, thereby effectively simplifying a structure of the pixel driving circuit and facilitating a realization of an OLED product having a narrow bezel and high pixels per inch (PPI, the number of pixels per inch) display.

Specifically, the preset duration may be greater than or equal to a duration during which the potential at the first electrode of the second transistor Q2 rises from zero to the difference between the reset voltage Vref and the threshold voltage Vth of the second transistor Q2.

Figure 4:
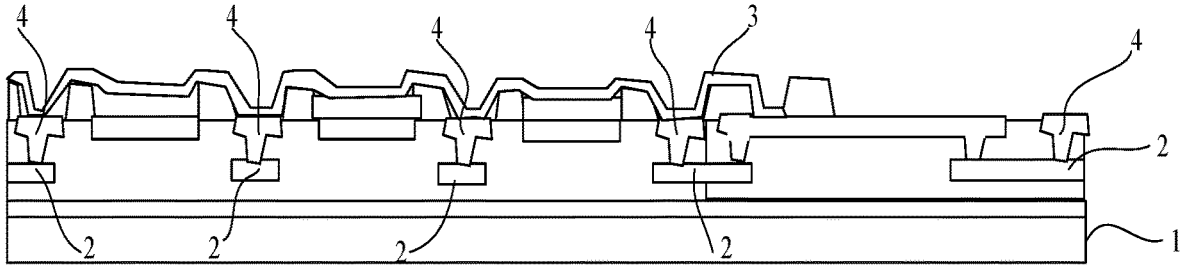
FIG. 4 is a schematic section view of an auxiliary cathode on a base substrate in embodiments of a pixel driving circuit according to the present disclosure.
Figure 5:
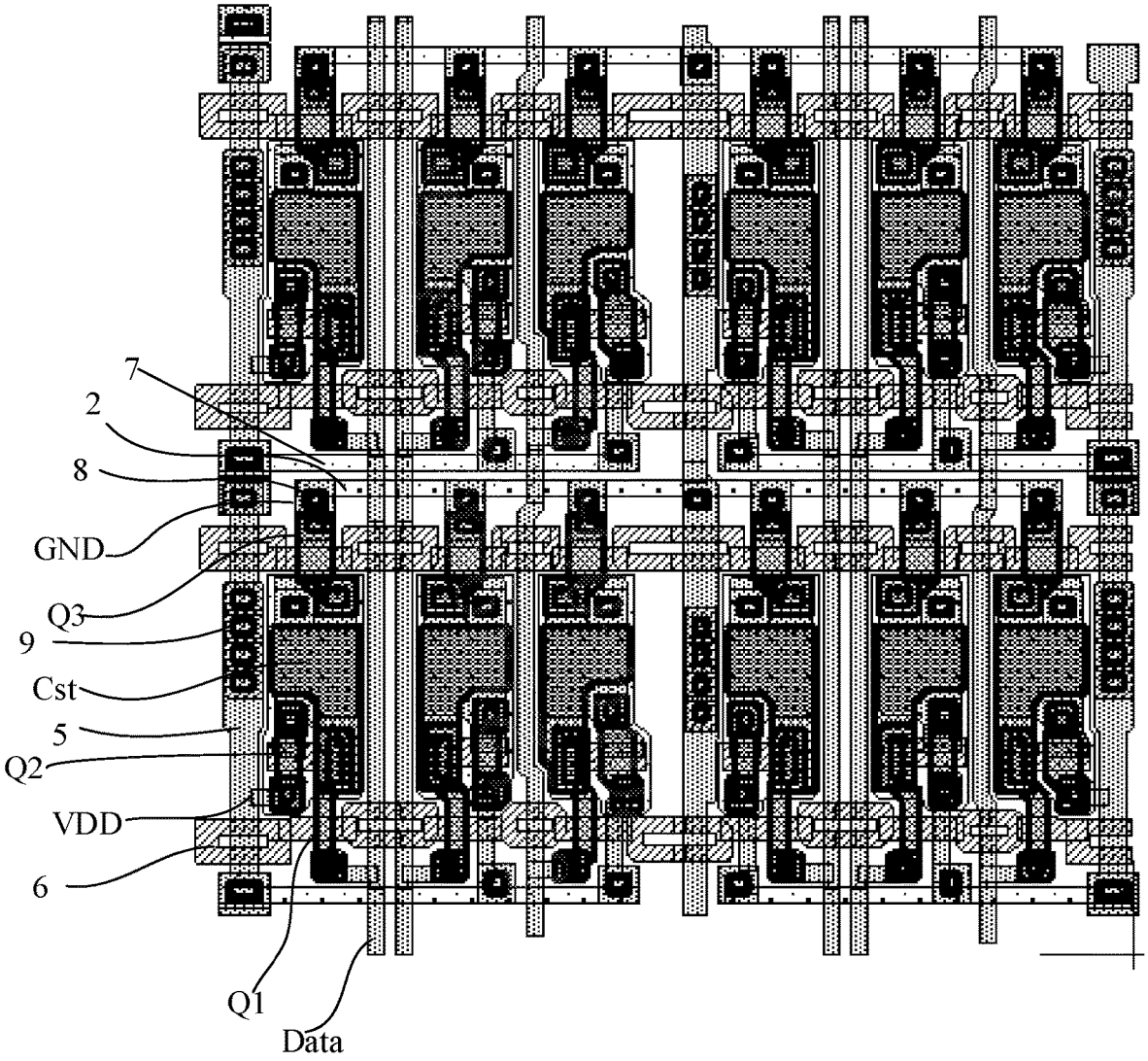
FIG. 5 is a plan layout of an embodiment of a pixel driving circuit on an array substrate according to the present disclosure.

Optionally, in some embodiments of the present disclosure, the array substrate is of a top emission structure. Referring to FIG. 4 and FIG. 5, an array substrate 1 may include an auxiliary cathode 2, and the second terminal of the reset switch circuit is coupled to a cathode 3 of the light-emitting device EL via the auxiliary cathode 2, to enable the reset switch circuit to reset the driving switch circuit directly via the auxiliary cathode, such that there is no need to introduce the reset signal Vinitial to the second terminal of the reset switch circuit in the pixel driving circuit, that is, there is no need to provide the sensing signal line in the pixel driving circuit to provide the reset signal Vinitial, thereby effectively simplifying the structure of the pixel driving circuit and facilitating the realization of the OLED product having the narrow bezel and high PPI display.

In FIG. 4, 1 denotes a base substrate, 2 denotes the auxiliary cathode, where the auxiliary cathode 2 is disposed in a source/drain (SD) layer of the array substrate, and 3 denotes the cathode of the light-emitting device, 4 denotes an anode layer of the array substrate.

Optionally, the array substrate includes the source/drain layer, a light-shield layer and a gate layer, the gate layer is coupled to the light-shield layer through a first via hole, and the gate layer is coupled to the source/drain layer through a second via hole.

Optionally, referring to FIG. 5, the reset switch circuit 13 is the third transistor Q3, e.g., a third NTFT Q3, and the auxiliary cathode 2 may be disposed in a same layer as first and second electrodes of the third transistor Q3 (e.g., a drain electrode and a source electrode of the third NTFT Q3). The first electrode of the third transistor Q3 acts as the first terminal of the reset switch circuit 13, and the second electrode of the third transistor Q3 acts as the second terminal of the reset switch circuit 13.

Specifically, referring to FIG. 5, a metal layer of the auxiliary cathode 2 and a metal layer formed by the first and second electrodes of the third transistor Q3 (e.g., the drain electrode and the source electrode of the third NTFT Q3) may be in a same layer and disposed on a SD layer 5, so that the second electrode of the third transistor Q3 (e.g., the source electrode of the third NTFT Q3) is coupled to the cathode 3 of the light-emitting device EL via the auxiliary cathode 2. The light-emitting device EL and the intrinsic capacitor Cel are not shown in FIG. 5

In FIG. 5, not only the auxiliary cathode 2, but also the first and second electrodes of the third transistor Q3 (e.g., the drain electrode and the source electrode of the third NTFT Q3) are disposed on the SD layer 5, the auxiliary cathode 2 is coupled to the second electrode of the third transistor Q3 (e.g., the source electrode of the third NTFT Q3), and the auxiliary cathode 2 is further coupled to the cathode 3 of the light-emitting device EL. An orthographic projection of the second electrode of the third transistor Q3 onto the base substrate 1 and an orthographic projection of the auxiliary cathode 2 onto the base substrate 1 at least partially overlap. A plurality of pixel driving circuits as shown in FIG. 3 are included in FIG. 5, and only one of the pluralities of pixel driving circuits is labeled. In FIG. 5, 6 denotes the gate (GT) layer, 7 denotes the light-shield layer, a first via hole 8 is a connect (CNT) hole for connecting the GT layer 6 and the light-shield layer 7, and a second via hole 9 is an interlayer dielectric (ILD) hole for connecting the GT layer 6 and the SD layer 5.

Optionally, in some embodiments of the present disclosure, the capacitance value of the intrinsic capacitor Cel may be greater than or equal to 8 times of the capacitance value of the storage capacitor Cst. For example, the capacitance value of the storage capacitor Cst may be 0.2 pf, and the capacitance value of the intrinsic capacitor Cel may be 2 pf, so that the amount of electric charges stored in the intrinsic capacitor Cel is far greater than the amount of electric charges stored in the storage capacitor Cst after the threshold voltage detection stage T2 of the pixel driving circuit, thereby maintaining the potential at the first terminal of the driving switch circuit 12 at the difference between the reset voltage Vref and the threshold voltage Vth of the driving switch circuit.

Optionally, in some embodiments of the present disclosure, the duration of the threshold voltage detection stage T2 of the pixel driving circuit may be greater than or equal to 15 us, so as to ensure that the potential at the first terminal of the driving switch circuit 12 may rise from zero to the difference between the reset voltage Vref and the threshold voltage Vth of the driving switch circuit in the threshold voltage detection stage T2.

Optionally, in some embodiments of the present disclosure, the first transistor Q1, the second transistor Q2 and the third transistor Q3 may be N-channel thin film transistors (NTFTs), so as to facilitate an implementation of the fabrication process of the pixel driving circuit and reduce a production cost of the pixel driving circuit. In FIG. 3, the data input switch circuit 11 is a first NTFT Q1, the driving switch circuit 12 is a second NTFT Q2, and the reset switch circuit 13 is a third NTFT Q3. A control electrode of the first NTFT Q1 acts as the control terminal of the data input switch circuit 11, a drain electrode of the first NTFT Q1 acts as the second terminal of the data input switch circuit 11, and a source electrode of the first NTFT Q1 acts as the first terminal of the data input switch circuit 11. A control electrode of the second NTFT Q2 acts as the control terminal of the driving switch circuit 12, a drain electrode of the second NTFT Q2 acts as the second terminal of the driving switch circuit 12, and a source electrode of the second NTFT Q2 acts as the first terminal of the driving switch circuit 12. A control electrode of the third NTFT Q3 acts as the control terminal of the reset switch circuit 13, a drain electrode of the third NTFT Q3 acts as the first terminal of the reset switch circuit 13, and a source electrode of the third NTFT Q3 acts as the second terminal of the reset switch circuit 13.

Figure 6:
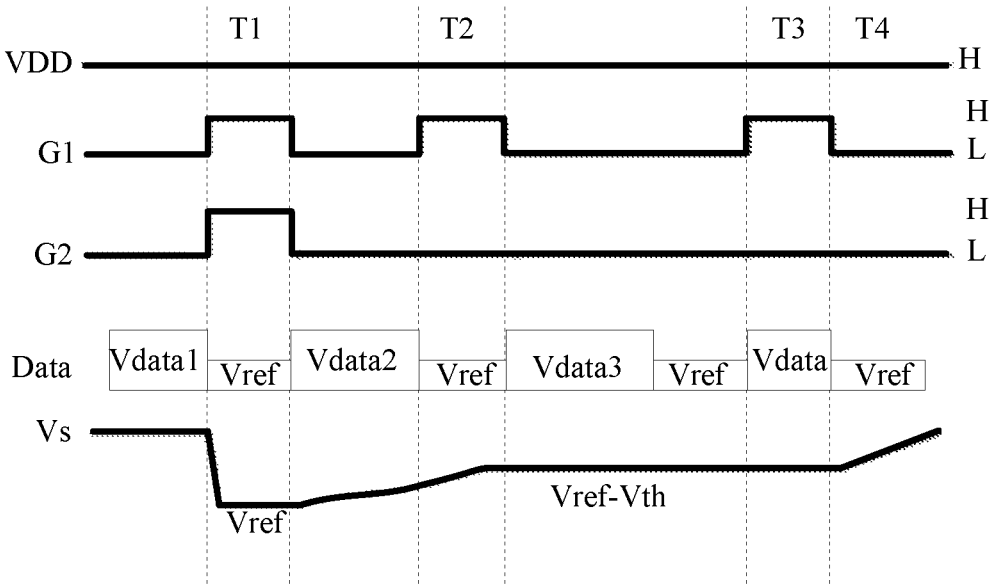
FIG. 6 is a schematic driving timing diagram corresponding to the pixel driving circuit as shown in FIG. 2.

Optionally, a driving timing corresponding to the pixel driving circuit shown in FIG. 3 may be as shown in FIG. 6. VDD denotes a power supply voltage waveform, G1 denotes a first scanning signal waveform, G2 denotes a second scanning signal waveform, Data denotes a waveform of the reset voltage Vref and the data signal Vdata on the data signal line, and Vs denotes a waveform of the potential at the first terminal of the driving switch circuit 12. It should be noted that a magnitude of potential in the timing diagram as shown in FIG. 6 is only illustrative, and does not represent a real value or relative proportion of the potential. In the embodiments of the present disclosure, a low level signal L corresponds to an off signal of an N-channel transistor, and a high level signal H corresponds to an on signal of the N-channel transistor.

As shown in FIG. 6, a driving process of the pixel driving circuit as shown in FIG. 3 includes a reset stage T1, a threshold voltage detection stage T2, a data writing and compensation stage T3 and a light-emitting stage T4.

During the reset stage T1, the first scanning signal G1 and the second scanning signal G2 are input, and the third transistor Q3 and the first transistor Q1 are turned on. The first transistor Q1 transmits the reset voltage Vref on the data signal line Data, and the second transistor Q2 is turned on via the third transistor Q3 and the first transistor Q1, to reset the second transistor Q2.

During the reset stage T1, a potential Vg at the gate electrode of the second transistor Q2 is Vref, the reset voltage Vref is greater than the threshold voltage Vth of the second transistor Q2, a potential Vs at the source electrode of the second transistor Q2 is 0 v, thus a gate-source potential difference Vgs of the second transistor Q2 is Vref. An influence of a hysteresis of the normally-on second transistor Q2 on detecting the threshold voltage of the second transistor Q2 may be eliminated by the reset stage T1.

During the threshold voltage detection stage T2, the first scanning signal G1 is input, the first transistor Q1 remains on and the third transistor Q3 is turned off. The first transistor Q1 transmits the reset voltage Vref on the data signal line Data. The second transistor Q2 is turned off after the threshold voltage Vth of the second transistor Q2 is detected via the first transistor Q1 and the intrinsic capacitor Cel.

During the threshold voltage detection stage T2, the potential Vg at the gate electrode of the second transistor Q2 is Vref, the potential Vs at the source electrode of the second transistor Q2 rises from 0 v to Vref-Vth. In consideration of a rising process of the voltage Vs, a duration of the threshold voltage detection stage is required to be greater than or equal to the preset duration. At this time, the second transistor Q2 is turned off. Before the second transistor Q2 is turned off, the intrinsic capacitor Cel and the storage capacitor Cst are charged by the power supply VDD via the second transistor Q2, and the intrinsic capacitor Cel and the storage capacitor Cst store electric charges. Since the capacitance value of the intrinsic capacitor Cel is greater than or equal to the preset multiple of the capacitance value of the storage capacitor Cst, when the third transistor Q3 is turned off, a gate potential variation of the second transistor Q2 has a very small effect, which may be negligible, on the potential at the source electrode of the second transistor Q2.

During the data writing and compensation stage T3, the first scanning signal G1 is input, the first transistor Q1 remains on and the third transistor Q3 remains off. The data signal Vdata on the data signal line Data is input via the first transistor Q1, to turn on the second transistor Q2. The intrinsic capacitor Cel compensates for the threshold voltage Vth and the mobility k of the second transistor Q2.

During the data writing and compensation stage T3, the potential Vg at the gate electrode of the second transistor Q2 is Vdata. Due to a short on-duration of the second transistor Q2 in the data writing and compensation stage T3, the time available for the power supply VDD to charge the intrinsic capacitor Cel and the storage capacitor Cst via the second transistor Q2 is short, and the variance of the potential at the source electrode of the second transistor Q2 caused by charging the intrinsic capacitor Cel is small, thus it may be considered that the potential at the source electrode of the second transistor Q2 remains unchanged, that is, the potential Vs at the source electrode of the second transistor Q2 is Vref-Vth. Since the driving current $Ids=k(Vgs-Vth)^2=k(Vdata-Vref)^2$, where k is the mobility of the second transistor Q2, the driving current Ids of the second transistor Q2 is independent of the magnitude of threshold voltage Vth of the second transistor Q2, thereby the compensation for the threshold voltage Vth of the second transistor Q2 is realized.

In addition, since the second transistor Q2 is turned on during the data writing and compensation stage T3, the intrinsic capacitor Cel is charged by the power supply VDD via the second transistor Q2, and the potential Vs at the source electrode of the second transistor Q2 is in effect greater than Vref-Vth. Assuming that the variance of the potential at the source electrode of the second transistor Q2 is ΔVs, the ΔVs includes a variance of the mobility k of the second transistor Q2. Therefore, the compensation for the drift of the mobility k of the second transistor Q2 may also be realized during the data writing and compensation stage T3.

During the light-emitting stage T4, the first transistor Q1 is turned off, and the second transistor Q2 drives the light-emitting device EL to emit light. Since the driving current Ids of the second transistor Q2 is independent of the magnitude of the threshold voltage Vth of the second transistor Q2, and the drift of the mobility k of the second transistor Q2 is compensated for, a display device adopting the pixel driving circuit according to the embodiments of the present disclosure has good display brightness uniformity, and may achieve high PPI display.

The pixel driving circuit according to the embodiments of the present disclosure has the following advantages. The pixel driving circuit includes the data input switch circuit, the driving switch circuit, the reset switch circuit, the light-emitting device, the storage capacitor and the intrinsic capacitor, the control terminal of the driving switch circuit is coupled to the first terminal of the data input switch circuit, the first terminal of the driving switch circuit is coupled to the anode of the light-emitting device, two terminals of the storage capacitor are respectively coupled to the control terminal of the driving switch circuit and the anode of the light-emitting device, and two terminals of the intrinsic capacitor are respectively coupled to the cathode of the light-emitting device and the anode of the light-emitting device, the first terminal of the reset switch circuit is coupled to the anode of the light-emitting device, the second terminal of the reset switch circuit is coupled to the cathode of the light-emitting device, the capacitance value of the intrinsic capacitor is greater than or equal to the preset multiple of the capacitance value of the storage capacitor, and the duration of the threshold voltage detection stage of the pixel driving circuit is greater than or equal to the preset duration. In the embodiments of the present disclosure, not only the drifts of the threshold voltage and the mobility of the driving switch circuit may be compensated for, but also the reset switch circuit may reset the driving switch circuit without the reset signal Vinitial since the second terminal of the reset switch circuit is coupled to the cathode of the light-emitting device, such that there is no need to introduce the reset signal Vinitial to the second terminal of the reset switch circuit in the pixel driving circuit, that is, there is no need to provide the sensing signal line in the pixel driving circuit to provide the reset signal Vinitial, thereby effectively simplifying the structure of the pixel driving circuit and facilitating the realization of the OLED product having the narrow bezel and high PPI display.

An array substrate is further provided in the embodiments of the present disclosure. The array substrate includes: a plurality of pixel units arranged in an array, where each of the plurality of pixel units includes the pixel driving circuit described above.

The array substrate in the embodiments of the present disclosure has the following advantages. The pixel driving circuit is provided. The pixel driving circuit includes the data input switch circuit, the driving switch circuit, the reset switch circuit, the light-emitting device, the storage capacitor and the intrinsic capacitor, the control terminal of the driving switch circuit is coupled to the first terminal of the data input switch circuit, the first terminal of the driving switch circuit is coupled to the anode of the light-emitting device, two terminals of the storage capacitor are respectively coupled to the control terminal of the driving switch circuit and the anode of the light-emitting device, and two terminals of the intrinsic capacitor are respectively coupled to the cathode of the light-emitting device and the anode of the light-emitting device, the first terminal of the reset switch circuit is coupled to the anode of the light-emitting device, the second terminal of the reset switch circuit is coupled to the cathode of the light-emitting device, the capacitance value of the intrinsic capacitor is greater than or equal to the preset multiple of the capacitance value of the storage capacitor, and the duration of the threshold voltage detection stage of the pixel driving circuit is greater than or equal to the preset duration. In the embodiments of the present disclosure, not only the drifts of the threshold voltage and the mobility of the driving switch circuit may be compensated for, but also the reset switch circuit may reset the driving switch circuit without the reset signal Vinitial since the second terminal of the reset switch circuit is coupled to the cathode of the light-emitting device, such that there is no need to introduce the reset signal Vinitial to the second terminal of the reset switch circuit in the pixel driving circuit, that is, there is no need to provide the sensing signal line in the pixel driving circuit to provide the reset signal Vinitial, thereby effectively simplifying the structure of the pixel driving circuit and facilitating the realization of the OLED product having the narrow bezel and high PPI display.

A display device is further provided in the embodiments of the present disclosure. The display device includes the array substrate described above. Specifically, the display device according to the embodiments of the present disclosure may be an OLED panel or an AMOLED panel.

The display device in the embodiments of the present disclosure has the following advantages. The pixel driving circuit in the array substrate is provided. The pixel driving circuit includes the data input switch circuit, the driving switch circuit, the reset switch circuit, the light-emitting device, the storage capacitor and the intrinsic capacitor, the control terminal of the driving switch circuit is coupled to the first terminal of the data input switch circuit, the first terminal of the driving switch circuit is coupled to the anode of the light-emitting device, two terminals of the storage capacitor are respectively coupled to the control terminal of the driving switch circuit and the anode of the light-emitting device, and two terminals of the intrinsic capacitor are respectively coupled to the cathode of the light-emitting device and the anode of the light-emitting device, the first terminal of the reset switch circuit is coupled to the anode of the light-emitting device, the second terminal of the reset switch circuit is coupled to the cathode of the light-emitting device, the capacitance value of the intrinsic capacitor is greater than or equal to the preset multiple of the capacitance value of the storage capacitor, and the duration of the threshold voltage detection stage of the pixel driving circuit is greater than or equal to the preset duration. In the embodiments of the present disclosure, not only the drifts of the threshold voltage and the mobility of the driving switch circuit may be compensated for, but also the reset switch circuit may reset the driving switch circuit without the reset signal Vinitial since the second terminal of the reset switch circuit is coupled to the cathode of the light-emitting device, such that there is no need to introduce the reset signal Vinitial to the second terminal of the reset switch circuit in the pixel driving circuit, that is, there is no need to provide the sensing signal line in the pixel driving circuit to provide the reset signal Vinitial, thereby effectively simplifying the structure of the pixel driving circuit and facilitating the realization of the OLED product having the narrow bezel and high PPI display.

A method for driving the aforementioned pixel driving circuit is further provided in the embodiments of the present disclosure. FIG. 6 is a timing diagram of a method for driving the pixel driving circuit provided by embodiments of the present disclosure. The method for driving the pixel driving circuit provided by the embodiments of the present disclosure will be described below with reference to the timing diagram as shown in FIG. 6. It should be noted that the magnitude of potential in the timing diagram as shown in FIG. 6 is only illustrative, and does not represent a real value or relative proportion of the potential. In the embodiments of the present disclosure, a low-level signal L corresponds to an off signal of an N-channel transistor, and a high level signal H corresponds to an on signal of the N-channel transistor.

As shown in FIG. 6, the method for driving the pixel driving circuit provided by the embodiments of the present disclosure may include four stages, i.e., the reset stage T1, the threshold voltage detection stage T2, the data writing and compensation stage T3 and the light-emitting stage T4.

During the reset stage T1, the first scanning signal G1 and the second scanning signal G2 are input, and the reset switch circuit and the data input switch circuit are turned on. The data input switch circuit transmits the reset voltage Vref on the data signal line Data, and the driving switch circuit is turned on via the reset switch circuit and the data input switch circuit to reset the driving switch circuit.

During the reset stage T1, a potential Vg at the gate electrode of the driving switch circuit is Vref, the reset voltage Vref is greater than the threshold voltage Vth of the driving switch circuit, a potential Vs at the source electrode of the driving switch circuit is 0 v, thus a gate-source potential difference Vgs of the driving switch circuit is Vref. An influence of a hysteresis of the normally-on driving switch circuit on detecting the threshold voltage of the driving switch circuit may be eliminated by the reset stage T1.

During the threshold voltage detection stage T2, the first scanning signal G1 is input, the data input switch circuit remains on and the reset switch circuit is turned off. The data input switch circuit transmits the reset voltage Vref on the data signal line Data. The driving switch circuit is turned off after the threshold voltage Vth of the driving switch circuit is detected via the data input switch circuit and the intrinsic capacitor Cel.

During the threshold voltage detection stage T2, the potential Vg at the gate electrode of the driving switch circuit is Vref, the potential Vs at the source electrode of the driving switch circuit is Vref-Vth, therefore the driving switch circuit is turned off. Before the driving switch circuit is turned off, the intrinsic capacitor Cel and the storage capacitor Cst are charged by the power supply VDD via the driving switch circuit, and the intrinsic capacitor Cel and the storage capacitor Cst store electric charges. Since the capacitance value of the intrinsic capacitor Cel is greater than or equal to the preset multiple of the capacitance value of the storage capacitor Cst, when the reset switch circuit is turned off, a gate potential variation of the driving switch circuit has a very small effect, which may be negligible, on the potential at the source electrode of the driving switch circuit. A duration of the threshold voltage detection stage may be greater than or equal to the preset duration, e.g., 15 us, so as to ensure that the potential at the first terminal of the driving switch circuit may rise from zero to the difference between the reset voltage and the threshold voltage of the driving switch circuit during the threshold voltage detection stage.

During the data writing and compensation stage T3, the first scanning signal G1 is input, the data input switch circuit remains on and the reset switch circuit remains off. The data signal Vdata on the data signal line Data is input via the data input switch circuit, to turn on the driving switch circuit. The intrinsic capacitor Cel compensates for the threshold voltage Vth and the mobility k of the driving switch circuit.

During the data writing and compensation stage T3, the potential Vg at the gate electrode of the driving switch circuit is Vdata. Due to a short on-duration of the driving switch circuit in the data writing and compensation stage T3, the time available for the power supply VDD to charge the intrinsic capacitor Cel and the storage capacitor Cst via the driving switch circuit is short, and the variance of the potential at the source electrode of the driving switch circuit caused by charging the intrinsic capacitor Cel is small, thus it may be considered that the potential at the source electrode of the driving switch circuit remains unchanged, that is, the potential Vs at the source electrode of the driving switch circuit is Vref-Vth. Since the driving current $Ids=k(Vgs-Vth)^2=k(Vdata-Vref)^2$, where k is the mobility of the driving switch circuit, the driving current Ids of the driving switch circuit is independent of the magnitude of threshold voltage Vth of the driving switch circuit, thereby the compensation for the threshold voltage Vth of the driving switch circuit is realized.

In addition, since the driving switch circuit is turned on during the data writing and compensation stage T3, the intrinsic capacitor Cel is charged by the power supply VDD via the driving switch circuit, the potential Vs at the source electrode of the driving switch circuit is in effect greater than Vref-Vth. Assuming that the variance of the potential at the source electrode of the driving switch circuit is ΔVs, the ΔVs includes a variance of the mobility k of the driving switch circuit. Therefore, the compensation for the drift of the mobility k of the driving switch circuit may also be realized during the data writing and compensation stage T3.

During the light-emitting stage T4, the data input switch circuit is turned off, and the driving switch circuit drives the light-emitting device EL to emit light.

Since the driving current Ids of the driving switch circuit is independent of the magnitude of the threshold voltage Vth of the driving switch circuit, and the drift of the mobility k of the driving switch circuit is compensated for, a display device adopting the pixel driving circuit according to the embodiments of the present disclosure has good display brightness uniformity, and may achieve high PPI display.

The method for driving the pixel driving circuit in the embodiments of the present disclosure has the following advantages. The pixel driving circuit includes the data input switch circuit, the driving switch circuit, the reset switch circuit, the light-emitting device, the storage capacitor and the intrinsic capacitor, the control terminal of the driving switch circuit is coupled to the first terminal of the data input switch circuit, the first terminal of the driving switch circuit is coupled to the anode of the light-emitting device, two terminals of the storage capacitor are respectively coupled to the control terminal of the driving switch circuit and the anode of the light-emitting device, and two terminals of the intrinsic capacitor are respectively coupled to the cathode of the light-emitting device and the anode of the light-emitting device, the first terminal of the reset switch circuit is coupled to the anode of the light-emitting device, the second terminal of the reset switch circuit is coupled to the cathode of the light-emitting device, the capacitance value of the intrinsic capacitor is greater than or equal to the preset multiple of the capacitance value of the storage capacitor, and the duration of the threshold voltage detection stage of the pixel driving circuit is greater than or equal to the preset duration. In the embodiments of the present disclosure, not only the drifts of the threshold voltage and the mobility of the driving switch circuit may be compensated for, but also the reset switch circuit may reset the driving switch circuit without the reset signal Vinitial since the second terminal of the reset switch circuit is coupled to the cathode of the light-emitting device, such that there is no need to introduce the reset signal Vinitial to the second terminal of the reset switch circuit in the pixel driving circuit, that is, there is no need to provide the sensing signal line in the pixel driving circuit to provide the reset signal Vinitial, thereby effectively simplifying the structure of the pixel driving circuit and facilitating the realization of the OLED product having the narrow bezel and high PPI display.

The embodiments of the array substrate and the display device are described in a relatively simple manner since they include the pixel driving circuit, and for related descriptions, a reference may be made to some of the descriptions of the pixel driving circuit embodiment. As for the embodiment of the method for driving the pixel driving circuit, a reference may be made to some of the descriptions of the pixel driving circuit embodiment for related descriptions of the pixel driving circuit.

The embodiments provided in the specification are described in a progressive manner and the description of each embodiment focuses on its difference from other embodiments, thus the same or similar part among various embodiments may be referred with each other.

Those skilled in the art should understand that the embodiments of the present disclosure may be provided as a method, a device, or a computer program product. Therefore, the embodiments of the present disclosure may be in form of a full hardware embodiment, a full software embodiment, or an embodiment combining software and hardware. Moreover, the embodiments of the present disclosure may be in form of a computer program product implemented on one or more computer-usable storage media (including, but not limited to, magnetic disk storage, CD-ROM, optical storage, etc.) including computer-usable program codes.

The embodiments of the present disclosure are described with reference to flowcharts and/or block diagrams of the method, terminal device (system) and computer program product according to the embodiments of the present disclosure. It should be appreciated that each process in the flowcharts and/or each block in the block diagrams, and a combination of processes in the flowcharts and/or blocks in the block diagrams may be implemented by computer program instructions. The computer program instructions may be provided to a general purpose computer, a special purpose computer, an embedded processor, or a processor of other programmable data processing terminal device to create a machine, such that the instructions executed by the computer or the processor of other programmable data processing terminal device create a device for implementing functions specified in one or more processes in the flowcharts and/or one or more blocks in the block diagrams.

The computer program instructions may also be stored in a computer-readable storage capable of directing a computer or other programmable data processing terminal device to operate in a particular manner, such that the instructions stored in the computer-readable storage create an article of manufacture including an instruction device, and the instruction device implements functions specified in one or more processes in the flowcharts and/or one or more blocks in the block diagrams.

The computer program instructions may also be loaded into the computer or other programmable data processing terminal device, so that a series of operational steps may be performed on the computer or other programmable terminal device to produce computer-implemented processing, and thus the instructions executed by the computer or other programmable terminal device provide steps for implementing the functions specified in one or more processes in the flowcharts and/or one or more blocks in the block diagrams.

Although optional embodiments of the present disclosure have been described, those skilled in the art may make other replacements and modifications to these embodiments once they know basic inventive concepts of the present disclosure. Therefore, the appended claims are intended to be construed as including the optional embodiments and all replacements and modifications that fall within the scope of the embodiments of the present disclosure.

It should be noted that in the present disclosure, relational terms such as first and second are used only to distinguish one entity or operation from another entity or operation, and do not necessarily require or imply that there is any such actual relationship or order between the entities or operations. Moreover, a term "include", "have" or any other variation thereof are intended to encompass non-exclusive inclusion, such that a process, method, article or terminal device including a series of elements includes not only those elements, but also other elements not explicitly listed, or elements inherent to the process, method, article or terminal device. Without more restrictions, an element preceded by an expression "including a . . . " does not exclude the existence of other identical elements in the process, method, article or terminal device including the element.

The pixel driving circuit, the array substrate, the display device, and the method for driving the pixel driving circuit in the present disclosure have been described in detail. Specific examples are used herein to describe the principles and implementations of the present disclosure, and the description of the above embodiments is only used to facilitate an understanding of the method of the present disclosure and its core ideas. Meanwhile, a person of ordinary skill in the art may make changes in the specific implementations and application scopes according to the ideas of the present disclosure. Therefore, the content of the specification should not be construed as a limitation on the present disclosure.

What is claimed is:

1. A pixel driving circuit, applied to an array substrate, comprising: a data input switch circuit, a driving switch circuit, a reset switch circuit, a light-emitting device, a storage capacitor and an intrinsic capacitor, wherein a control terminal of the driving switch circuit is coupled to a first terminal of the data input switch circuit, a first terminal of the driving switch circuit is coupled to an anode of the light-emitting device, two terminals of the storage capacitor are respectively coupled to the control terminal of the driving switch circuit and the anode of the light-emitting device, two terminals of the intrinsic capacitor are respectively coupled to a cathode of the light-emitting device and the anode of the light-emitting device, a first terminal of the reset switch circuit is coupled to the anode of the light-emitting device, a second terminal of the reset switch circuit is coupled to the cathode of the light-emitting device, a capacitance value of the intrinsic capacitor is greater than or equal to a preset multiple of a capacitance value of the storage capacitor, and a duration of a threshold voltage detection stage of the pixel driving circuit is greater than or equal to a preset duration, wherein the duration of the threshold voltage detection stage of the pixel driving circuit is greater than or equal to 15 microseconds.

2. The pixel driving circuit according to claim 1, wherein the array substrate comprises an auxiliary cathode, and the second terminal of the reset switch circuit is coupled to the cathode of the light-emitting device via the auxiliary cathode.

3. The pixel driving circuit according to claim 2, wherein the reset switch circuit is a third transistor, and the auxiliary cathode is disposed in a same layer as first and second electrodes of the third transistor.

4. The pixel driving circuit according to claim 3, wherein the array substrate further comprises a base substrate, an orthographic projection of the second electrode of the third transistor onto the base substrate and an orthographic projection of the auxiliary cathode onto the base substrate at least partially overlap.

5. The pixel driving circuit according to claim 1, wherein the capacitance value of the intrinsic capacitor is greater than or equal to 8 times of the capacitance value of the storage capacitor.

6. The pixel driving circuit according to claim 1, wherein the data input switch circuit comprises a first transistor, the driving switch circuit comprises a second transistor, a control electrode of the first transistor receives a first scanning signal, a first electrode of the first transistor is coupled to a control electrode of the second transistor, a second electrode of the first transistor is coupled to a data signal line; and the first transistor is configured to transmit a reset voltage and a data signal on the data signal line to the control electrode of the second transistor in response to the first scanning signal;

a first electrode of the second transistor is coupled to the anode of the light-emitting device, and a second electrode of the second transistor is coupled to a first voltage terminal.

7. The pixel driving circuit according to claim 6, wherein the reset switch circuit comprises a third transistor, a control electrode of the third transistor receives a second scanning signal, a first electrode of the third transistor is coupled to the anode of the light-emitting device, a second electrode of the third transistor is coupled to the cathode of the light-emitting device; and the third transistor is configured to apply the reset voltage transmitted by the first transistor to the control electrode of the second transistor in response to the second scanning signal.

8. The pixel driving circuit according to claim 7, wherein the first transistor, the second transistor and the third transistor are N-channel thin film transistors (NTFTs).

9. The pixel driving circuit according to claim 1, wherein the array substrate comprises a source/drain layer, a light-shield layer and a gate layer, the gate layer is coupled to the light-shield layer through a first via hole, and the gate layer is coupled to the source/drain layer through a second via hole.

10. An array substrate, comprising: a plurality of pixel units arranged in an array, wherein each of the plurality of pixel units comprises the pixel driving circuit according to claim 1.

11. A display device, comprising the array substrate according to claim 10.

12. A method for driving a pixel driving circuit the method comprising a reset stage, a threshold voltage detection stage, a data writing and compensation stage and a light-emitting stage;

wherein the pixel driving circuit is applied to an array substrate and comprises a data input switch circuit, a driving switch circuit, a reset switch circuit, a light-emitting device, a storage capacitor and an intrinsic capacitor, wherein a control terminal of the driving switch circuit is coupled to a first terminal of the data input switch circuit, a first terminal of the driving switch circuit is coupled to an anode of the light-emitting device, two terminals of the storage capacitor are respectively coupled to the control terminal of the driving switch circuit and the anode of the light-emitting device, two terminals of the intrinsic capacitor are respectively coupled to a cathode of the light-emitting device and the anode of the light-emitting device, a first terminal of the reset switch circuit is coupled to the anode of the light-emitting device, a second terminal of the reset switch circuit is coupled to the cathode of the light-emitting device, a capacitance value of the intrinsic capacitor is greater than or equal to a preset multiple of a capacitance value of the storage capacitor, and a duration of a threshold voltage detection stage of the pixel driving circuit is greater than or equal to a preset duration;

and wherein the method comprises, during the reset stage, turning on the reset switch circuit and the data input switch circuit, and turning on the driving switch circuit via the reset switch circuit and the data input switch circuit to reset the driving switch circuit;

during the threshold voltage detection stage, turning off the reset switch circuit, and turning off the driving switch circuit after detecting a threshold voltage of the driving switch circuit via the data input switch circuit and the intrinsic capacitor; the duration of the threshold voltage detection stage is greater than or equal to the preset duration;

during the data writing and compensation stage, inputting the data signal via the data input switch circuit, turning on the driving switch circuit, and compensating, by the intrinsic capacitor, for the threshold voltage and a mobility of the driving switch circuit;

during the light-emitting stage, turning off the data input switch circuit, and driving, by the driving switch circuit, the light-emitting device to emit light.

13. A pixel driving circuit, applied to an array substrate, comprising: a data input switch circuit, a driving switch circuit, a reset switch circuit, a light-emitting device, a storage capacitor and an intrinsic capacitor, wherein a control terminal of the driving switch circuit is coupled to a first terminal of the data input switch circuit, a first terminal of the driving switch circuit is coupled to an anode of the light-emitting device, two terminals of the storage capacitor are respectively coupled to the control terminal of the driving switch circuit and the anode of the light-emitting device, two terminals of the intrinsic capacitor are respectively coupled to a cathode of the light-emitting device and the anode of the light-emitting device, a first terminal of the reset switch circuit is coupled to the anode of the light-emitting device, a second terminal of the reset switch circuit is coupled to the cathode of the light-emitting device, a capacitance value of the intrinsic capacitor is greater than or equal to a preset multiple of a capacitance value of the storage capacitor, and a duration of a threshold voltage detection stage of the pixel driving circuit is greater than or equal to a preset duration, wherein the array substrate comprises an auxiliary cathode, and the second terminal of the reset switch circuit is coupled to the cathode of the light-emitting device via the auxiliary cathode, and wherein the reset switch circuit is a third transistor, and the auxiliary cathode is disposed in a same layer as first and second electrodes of the third transistor.

14. The pixel driving circuit according to claim 13, wherein the array substrate further comprises a base substrate, an orthographic projection of the second electrode of the third transistor onto the base substrate and an orthographic projection of the auxiliary cathode onto the base substrate at least partially overlap.

15. The pixel driving circuit according to claim 13, wherein the capacitance value of the intrinsic capacitor is greater than or equal to 8 times of the capacitance value of the storage capacitor.

16. The pixel driving circuit according to claim 13, wherein the data input switch circuit comprises a first transistor, the driving switch circuit comprises a second transistor, a control electrode of the first transistor receives a first scanning signal, a first electrode of the first transistor is coupled to a control electrode of the second transistor, a second electrode of the first transistor is coupled to a data signal line; and the first transistor is configured to transmit a reset voltage and a data signal on the data signal line to the control electrode of the second transistor in response to the first scanning signal;

a first electrode of the second transistor is coupled to the anode of the light-emitting device, and a second electrode of the second transistor is coupled to a first voltage terminal.

17. The pixel driving circuit according to claim 16, wherein the reset switch circuit comprises a third transistor, a control electrode of the third transistor receives a second scanning signal, a first electrode of the third transistor is coupled to the anode of the light-emitting device, a second electrode of the third transistor is coupled to the cathode of the light-emitting device; and the third transistor is configured to apply the reset voltage transmitted by the first transistor to the control electrode of the second transistor in response to the second scanning signal.

18. The pixel driving circuit according to claim 17, wherein the first transistor, the second transistor and the third transistor are N-channel thin film transistors (NTFTs).

19. An array substrate, comprising: a plurality of pixel units arranged in an array, wherein each of the plurality of pixel units comprises the pixel driving circuit according to claim 13.

20. A display device, comprising the array substrate according to claim 19.

* * * * *